US007948378B2

(12) United States Patent
Magargee et al.

(10) Patent No.: US 7,948,378 B2
(45) Date of Patent: May 24, 2011

(54) TAMPERPROOF NON-CONTACT SWITCH

(75) Inventors: Michael Magargee, Port Orange, FL (US); Robert Denney, Orlando, FL (US); William Porthouse, Oviedo, FL (US); Thornton Caraway, Deltona, FL (US)

(73) Assignee: Toptech Systems, Inc., Longwood, FL (US)

( * ) Notice: Subject to any disclaimer, the term of this patent is extended or adjusted under 35 U.S.C. 154(b) by 486 days.

(21) Appl. No.: 12/246,154

(22) Filed: Oct. 6, 2008

(65) Prior Publication Data

US 2010/0085186 A1 Apr. 8, 2010

(51) Int. Cl.
*G08B 13/08* (2006.01)

(52) U.S. Cl. ..... 340/547; 340/541; 340/542; 340/545.6; 340/551; 340/561; 340/565; 340/567; 340/568.1; 335/206; 335/207

(58) Field of Classification Search ..... 340/541, 340/542, 545.6, 551, 561, 565, 567, 568.1, 340/547; 335/206, 207
See application file for complete search history.

(56) References Cited

U.S. PATENT DOCUMENTS 2,019,262 A * 10/1935 Kauffman ..... 361/642
3,192,517 A * 6/1965 Werlin ..... 340/546
3,803,575 A * 4/1974 Gotanda ..... 340/522
4,209,777 A * 6/1980 Morrison ..... 340/547
4,258,346 A * 3/1981 Williams ..... 335/206
4,359,646 A * 11/1982 Mejia et al. ..... 307/116
5,534,849 A * 7/1996 McDonald et al. ..... 340/517
6,774,807 B1 * 8/2004 Lehfeldt et al. ..... 340/686.1
6,784,796 B2 * 8/2004 Johnston et al. ..... 340/568.1
7,218,223 B2 * 5/2007 Seal et al. ..... 340/551
7,468,664 B2 * 12/2008 Daughton et al. ..... 340/551
7,504,918 B2 * 3/2009 Prendergast et al. ..... 335/205
7,667,597 B2 * 2/2010 Fellows et al. ..... 340/545.6
2009/0102650 A1 * 4/2009 Diener et al. ..... 340/542

* cited by examiner

*Primary Examiner* — Daniel Wu
*Assistant Examiner* — Son M Tang
(74) *Attorney, Agent, or Firm* — Miller, Matthias & Hull LLP

(57) ABSTRACT

A non-defeatable magnetically actuatable switch device is shown and described for restricting access to industrial controls. The non-contact switch device employs one or more non-contact access switches, and an access key removably disposed in close proximity to each access switch. Removal or installation of an access key alters the electrical state of a corresponding access switch. A connected control unit determines a mode of operation, or grants permissions, based on the combination of access keys that are present or absent from the device. A lockable or sealable cover is provided over the access keys to limit unauthorized access. A tamper detection switch is also provided for the sole purpose of identifying foreign magnetic sources in the vicinity of the access switches to ensure that the device is non-defeatable. Furthermore, all access and tamper detection switches are magnetically actuatable and thus provide a completely contact-free means of securing and restricting access to sensitive controls and parameters.

13 Claims, 5 Drawing Sheets

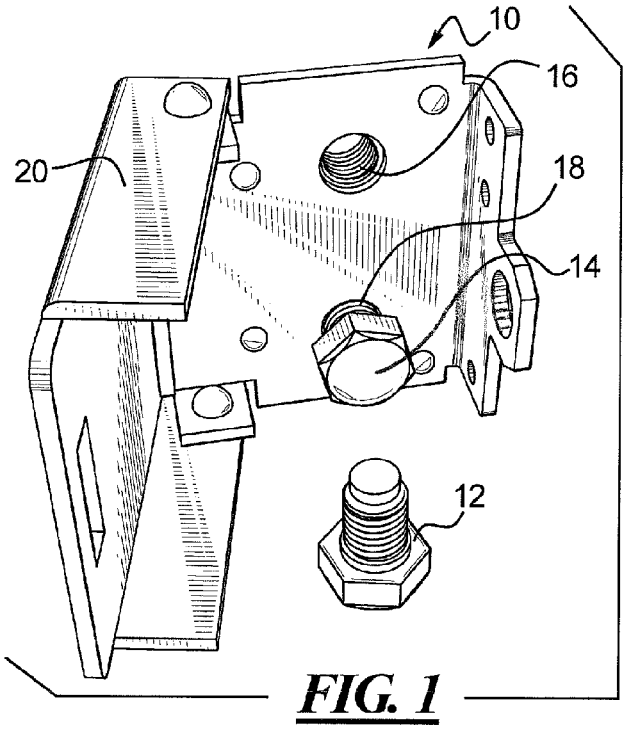
FIG. 1
FIG. 3
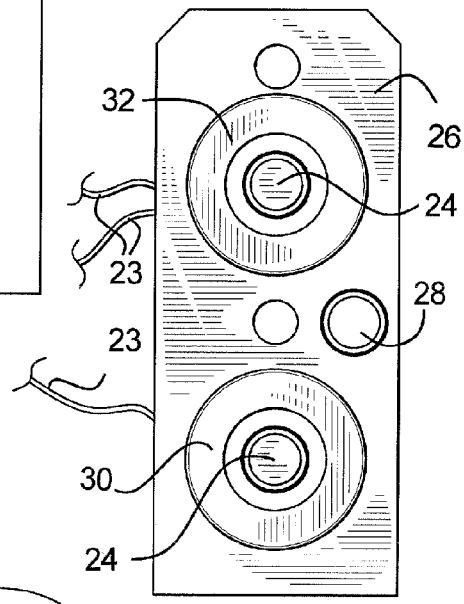
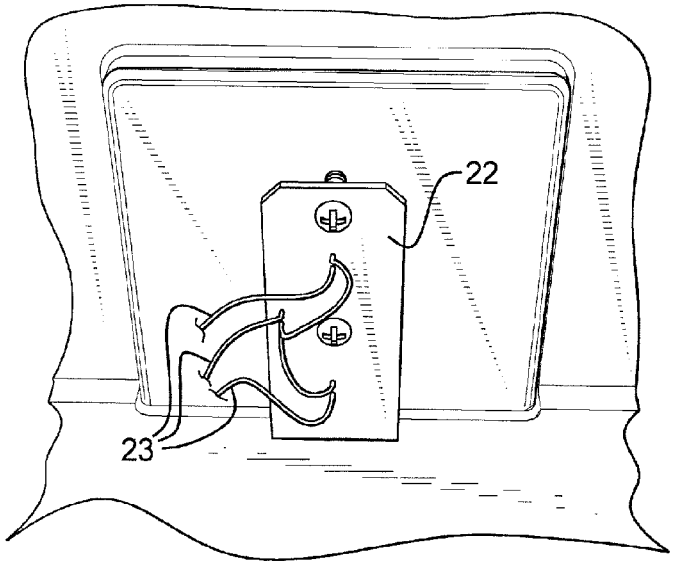
FIG. 2

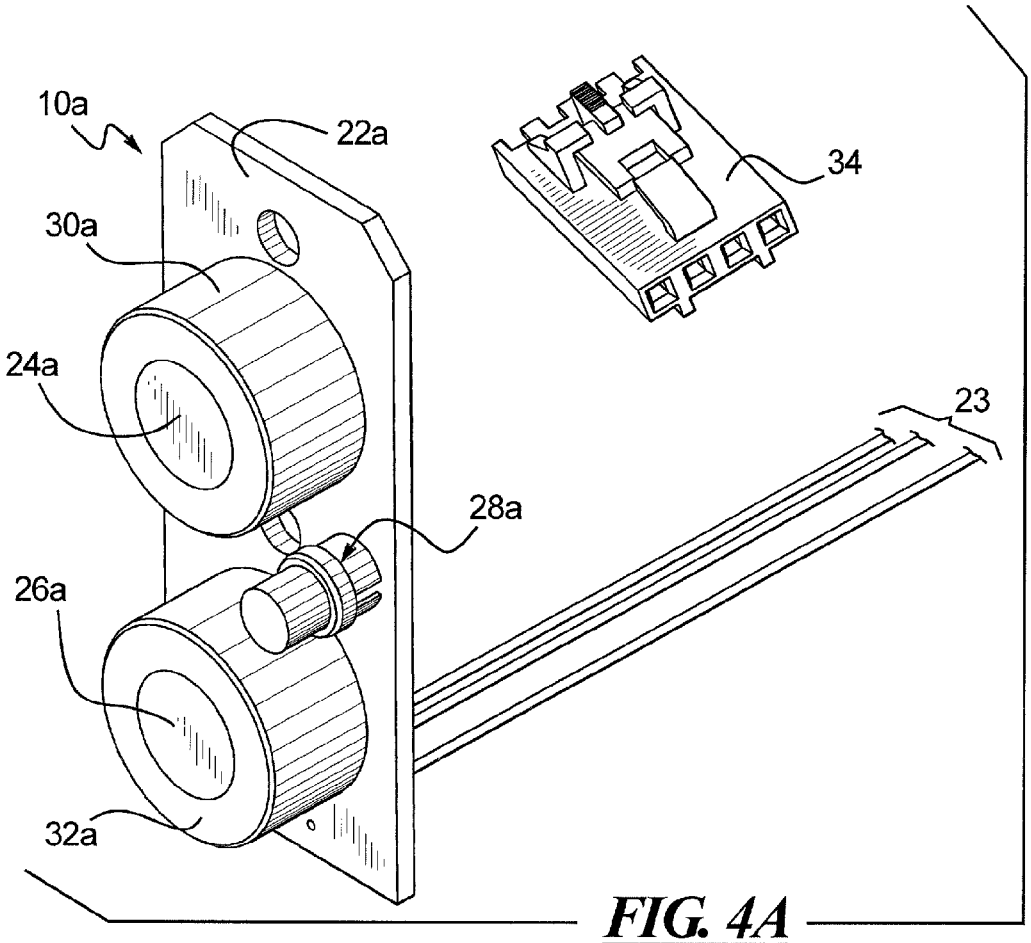
FIG. 4A
FIG. 4B
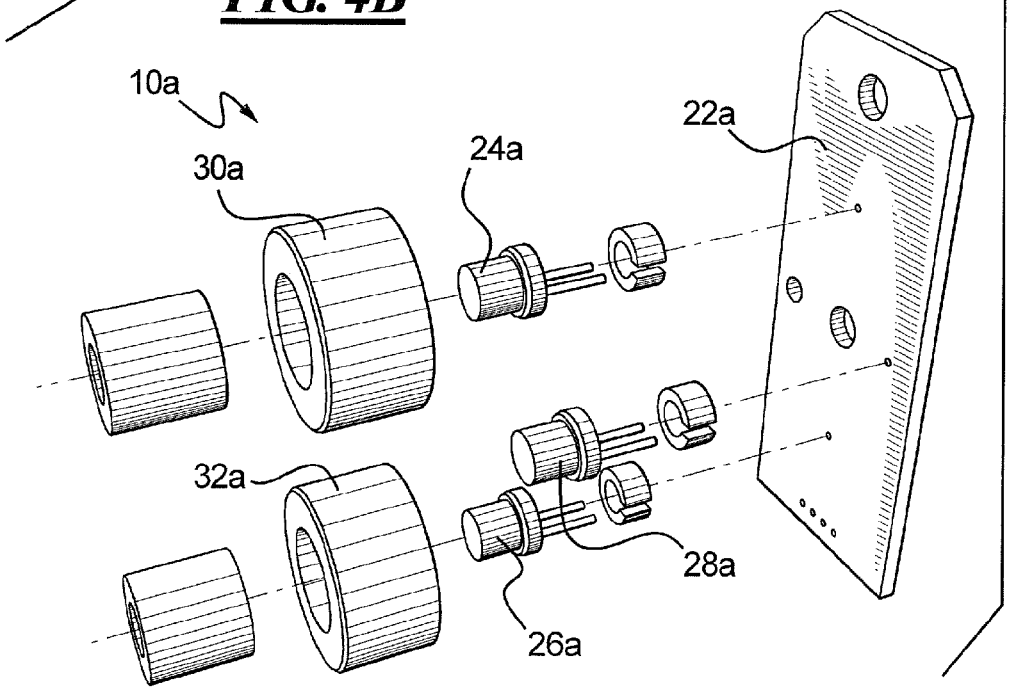

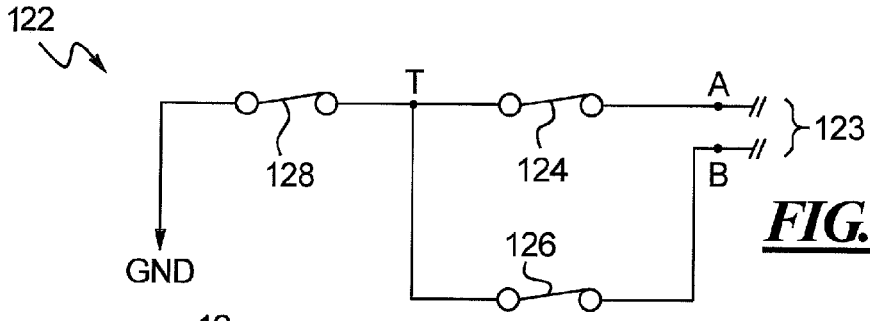
FIG. 5
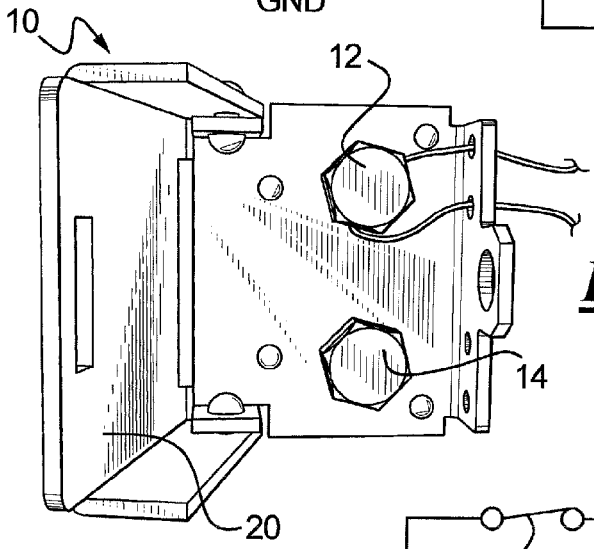
FIG. 6A
FIG. 6B
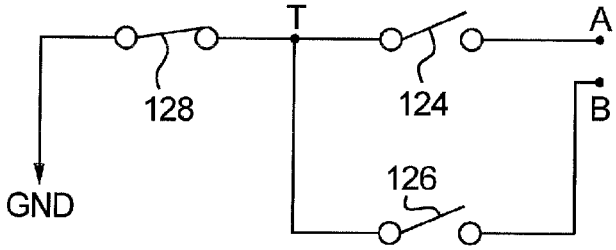
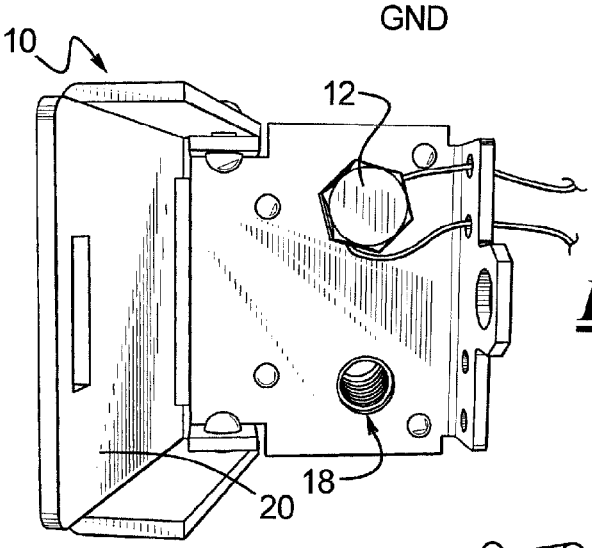
FIG. 7A
FIG. 7B
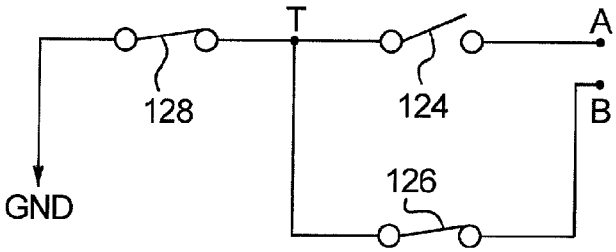

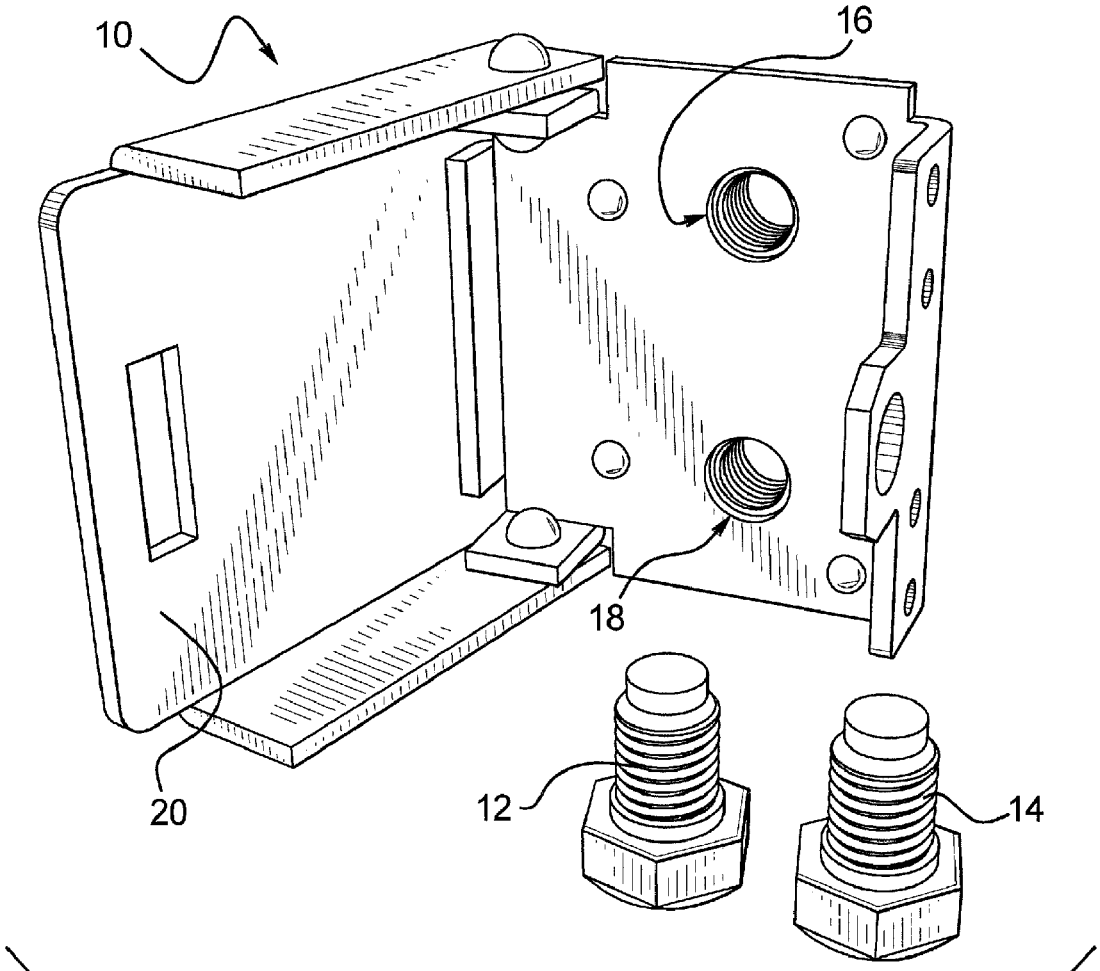
FIG. 8A
FIG. 8B
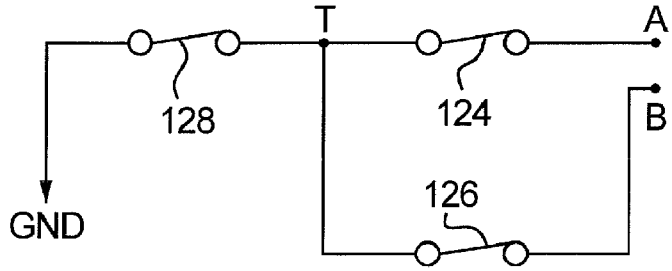

TAMPERPROOF NON-CONTACT SWITCH

BACKGROUND

1. Technical Field

An externally accessible switch device for securing and restricting access to data, configurations, parameters and other sensitive controls is disclosed. More specifically, a switch device for use with industrial control applications providing two or more magnetically actuatable non-contact switches capable of tamper detection is disclosed.

2. Description of the Related Art

Many process control devices require a switch to prevent users from re-programming or re-configuring a flow meter or scale. Such process control devices are used in the custody transfer of metered fluids which requires an agency sealable switch that keeps the user as well as the owner from modifying measurement, calibration, and calculation settings. Although the switches must be externally accessible, it is advantageous to use non-contact switches without through holes in the electronic enclosures. One advantage concerns the ingress protection that the enclosure provides against weather, dusts, and operator fingers. Sealing those things out makes for an electrically safer and more reliable product.

Other types of enclosures benefiting from the absence of through holes are those designed for use in a location where an explosion risk exits due to the presence of hazardous gases. These explosion-proof enclosures must contain an internal explosion resulting from an ignitable gas concentration coinciding with an internal electrical fault. The enclosure maintains safety by preventing a flame from exiting the enclosure and by resisting the resulting internal pressure wave. If a switch operator must pass through the enclosure, it must be certified for that use and for the expected gas hazards likely to be present.

An example of a currently existing design relies on a threaded shaft type of switch, manufactured by Adalet. This model XMOS carries an ATEX certificate and UL ratings for use with explosion-proof or flameproof enclosures. The shaft turns a selector switch inside the enclosure. However, these mechanical switches still do not provide a completely contact-free means of actuating. Other products such as Contrec and Isoil use brass bolts with magnetic heads installed from the exterior of an enclosure. These designs rely on explosion-proof construction and employ non-contact switch actuation as a simple means of maintaining the protective features of their enclosures. These magnetic switches, however, may be circumvented by external magnets. In particular, an unauthorized user with a sufficiently strong magnet can falsely actuate the magnetic switches and gain access to sensitive information without being detected.

Therefore, there is a need for an improved switch that can: operate from an exterior; be sensed from an interior; that minimizes agency costs associated with new product development and makes for better enclosure integrity. Specifically, there is a need for a non-contact magnetically actuatable switch capable of differentiating between authorized and unauthorized access.

While the following discussion will be directed toward non-contact tamperproof switches for industrial control applications, it will be noted that the devices disclosed herein are applicable to various fields beyond that of industrial control products and more generally can be applied to security devices utilizing magnetically actuatable switches.

SUMMARY OF THE DISCLOSURE

In satisfaction of the aforenoted needs, a non-defeatable non-contact switch capable of tamper detection is disclosed.

One disclosed tamperproof non-contact switch device for restricting access to a control unit includes at least two access switches and a tamper detection switch disposed on an interior of an access panel and at least two access keys removably disposed on an exterior of the access panel. The access and tamper detection switches are magnetically actuatable switches in electrical communication with the control unit. The access keys are configured to provide a magnetic field for actuating the access switches.

In a refinement, a lockable cover is provided over the exterior of the access panel to restrict access to the access keys.

In another refinement, the tamper detection switch is positioned to be equidistant from each of the access switches.

In another refinement, each access key is configured to be in axial alignment with its corresponding access switch.

In another refinement, the access keys are magnetized bolts.

In another refinement, the access keys are never in direct contact with the access switches.

In another refinement, the access keys are provided with a lead seal.

In another refinement, the access keys are unable to actuate the tamper detection switch.

In yet another refinement, ferrite rings are provided around the access switches to shield them from foreign magnetic fields.

Another tamperproof non-contact device for restricting access to a control unit is disclosed including an access panel, first and second access switches, a tamper detection switch, and first and second access keys. The access and tamper detection switches are disposed on an interior surface of the access panel. Further, the access and tamper detection switches are magnetically actuatable switches and in electrical communication with the control unit. The first and second access keys are removably disposed on an exterior of the access panel and magnetized to actuate the first and second access switches, respectively.

In a refinement, a lockable cover is provided over the exterior of the access panel to restrict access to the access keys.

In another refinement, the tamper detection switch is positioned to be equidistant from each of the access switches.

In another refinement, the access keys are never in direct contact with the access switches.

In another refinement, the access keys are provided with a lead seal.

In another refinement, the access keys are unable to actuate the tamper detection switch.

In yet another refinement, ferrite rings are provided around the access switches to shield them from foreign magnetic fields.

A tamperproof non-contact device for an enclosure restricting access to a control unit is disclosed having first and second access switches, a tamper detection switch, and first and second access keys. The access and tamper detection switches are disposed on an interior of the enclosure and magnetically actuatable. The access and tamper detection switches are also in electrical communication with the control unit. The first and second access keys are removably disposed on an exterior of the enclosure and magnetized to actuate the first and second access switches, respectively.

In a refinement, a lockable cover is provided over the access keys to restrict access thereof.

In another refinement, the first and second access keys are provided with a lead seal.

In yet another refinement, the first and second access switches are shielded with ferrite rings and the tamper detection switch is left unshielded.

Other advantages and features will be apparent from the following detailed description when read in conjunction with the attached drawings.

BRIEF DESCRIPTION OF THE DRAWINGS

The disclosed non-contact switch devices are described more or less diagrammatically in the accompanying drawings wherein:

FIG. 1 is a perspective view of an exterior of the tamperproof non-contact switch made in accordance with this disclosure;

FIG. 2 is perspective view of an interior of the non-contact switch of FIG. 1;

FIG. 3 is a plan view of a circuit for use with the non-contact switch of FIG. 1;

FIG. 4A is a perspective view of another non-contact switch;

FIG. 4B is an exploded perspective view of the non-contact switch of FIG. 4A;

FIG. 5 is an exemplary schematic of the circuitry of the non-contact switch of FIGS. 4A and 4B;

FIG. 6 is a perspective view of the non-contact switch of FIG. 1 in a first mode;

FIG. 7 is a perspective view of the non-contact switch of FIG. 1 in a second mode;

FIG. 8 is a perspective view of the non-contact switch of FIG. 1 in a third mode.

Figure 9A:
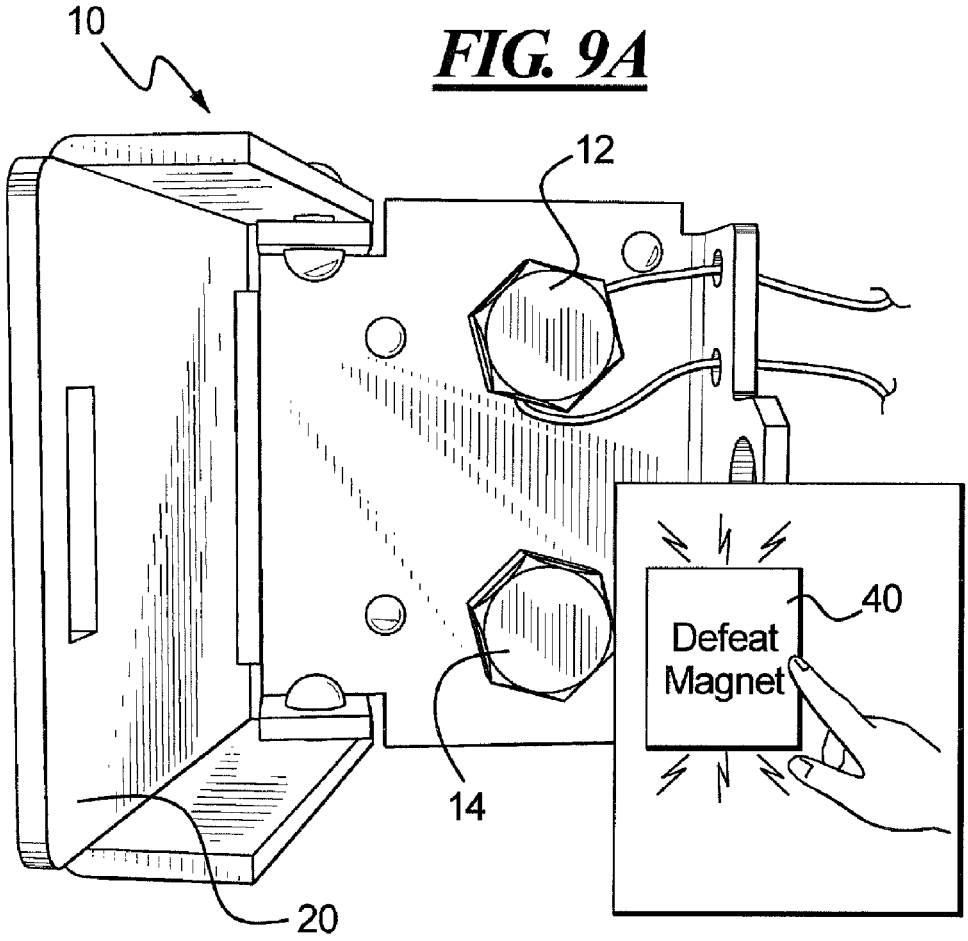
FIG. 9 is a perspective view of the non-contact switch of FIG. 1 in a tamper detection mode.

It should be understood that the drawings are not necessarily to scale and that the embodiments are sometimes illustrated by graphic symbols, phantom lines, diagrammatic representations and fragmentary views. In certain instances, details which are not necessary for an understanding of this disclosure or which render other details difficult to perceive may have been omitted. It should be understood, of course, that this disclosure is not limited to the particular embodiments and methods illustrated herein.

DETAILED DESCRIPTION OF THE PRESENTLY PREFERRED EMBODIMENTS

FIG. 1 illustrates an exterior view of a tamperproof non-contact switch 10 made in accordance with this disclosure. The exterior of the non-contact switch 10 may include two access keys 12, 14 removably inserted into two corresponding apertures 16, 18. The access keys 12, 14, as shown in FIG. 1, may use threaded bolts that are magnetized, or provided with a magnet on a tip thereof. Accordingly, the apertures 16, 18 may be threaded to receive the threaded bolts or access keys 12, 14. Alternatively, the access keys 12, 14 may be replaced with magnetized screws, keys, rods, bars, while the apertures 16, 18 may be unthreaded, slotted, keyed, or the like.

The tamperproof non-contact switch 10 of FIG. 1 may be positioned on a surface of an enclosure and configured to restrict access to a control unit that may contain sensitive data and control parameters. In particular, parameters of a control unit may be accessed only after the proper combination of access keys 12, 14 are present or absent from the apertures 16, 18. To restrict access to the access keys 12, 14 and thus the control unit parameters, a hinged cover 20 may be provided over the access keys 12, 14. When the control unit is not being accessed, the cover 20 may be locked in a closed position over the access keys 12, 14 using a padlock, combination lock, lead seals, or the like. An authorized user, such as an administrator or a programmer, with the proper key, combination, or the like, may unlock and open the cover 20 to gain access to the access keys 12, 14.

FIG. 2 illustrates an interior view of the tamperproof non-contact switch 10 of FIG. 1. The interior of the non-contact switch 10 may include a circuit board 22 that is coupled to an interior wall of an enclosure and wires 23 to communicate with a control unit. As FIG. 3 further illustrates, the circuit board 22 may provide a plurality of switches, for example, two access switches 24, 26 and one tamper detection switch 28. The switches 24, 26, 28 may be magnetically actuatable, or switches that change electrical state in the presence of a magnetic field. In particular, the switches 24, 26, 28 may be electrically closed or opened depending on the surrounding magnetic field. Each access switch 24, 26 may be configured to be in axial alignment with one of the apertures 16, 18 of FIG. 1, so as to detect the presence or absence of a corresponding access key 12, 14. Each access key 12, 14 may be magnetized so as to magnetically affect and alter the electrical state of a corresponding access switch 24, 26. The tamper detection switch 28 may be configured to detect tampering, or magnetic fields supplied by a source other than the magnetized access keys 12, 14. Furthermore, ferrite rings 30, 32 may be provided around each of the access switches 24, 26 to magnetically shield the access switches 24, 26 from actuating in response to an external or foreign source.

Referring now to FIGS. 4A and 4B, schematics of another tamperproof non-contact switch 10*a* are provided. As with the previous embodiment 10 of FIGS. 1 and 2, the non-contact switch 10*a* may include a circuit board 22*a* and wires 23*a* for electrically communicating with a control unit. In particular, the wires 23*a* may be coupled to a connector 34 as shown, which in turn, may be removably inserted into a port of a control unit. The circuit board 22*a* may include three magnetically actuatable switches. Specifically, the switches may comprise two access switches 24*a*, 26*a* and one tamper detection switch 28*a*. The access switches 24*a*, 26*a* may be provided with ferrite rings 30*a*, 32*a* to magnetically shield the switches 24*a*, 26*a* from actuating in response to a source other than the included access keys. In contrast, the tamper detection switch 28*a* may be left unshielded so it can classify such foreign magnetic sources as tampering and to subsequently deny access to a connected control unit. Furthermore, the tamper detection switch 28*a* may be positioned to be equidistant from each of the access switches 24*a*, 26*a*, as shown in FIGS. 4A and 4B. This provides the tamper detection switch 28*a* the ability to equally detect a foreign magnetic source in the vicinity of either access switch 24*a*, 26*a*. As FIGS. 1-4 illustrate, a tamperproof non-contact switch may be actuated securely, externally and without direct contact, and therefore, eliminates the need for drilling holes or puncturing walls through sensitive enclosures.

Turning to FIG. 5, an exemplary circuit 122 for a tamperproof non-contact switch is disclosed. As illustrated, the circuit 122 may include two access switches 124, 126 and one tamper detection switch 128 corresponding to, for example, the magnetically actuatable switches 24*a*, 26*a*, 28*a* of FIGS. 4A and 4B, respectively. The first access switch 124 may be coupled to a node indicated as node A, while the second access switch 126 may be coupled to a node indicated as node B. Each of the access switches 124, 126 may be connected in series with a tamper detection switch 128 at node T, while the tamper detection switch 128 provides an electrical switch between node T and ground, or a common DC reference. A control unit may monitor the status of each of the access switches 124, 126 via wires 123 electrically coupled to nodes A, B. Each of the access and tamper detection switches 124, 126, 128 may be normally-closed, or switches providing a closed circuit at times when a magnetic field is not present and an open circuit when a magnetic field is present. The circuit 122 may also be modified to be used with normally-opened switches, or switches providing an open circuit at times when a magnetic field is not present and a closed circuit when a magnetic field is present. Additionally, the circuit 122 may include fewer or a greater number of switches depending on a particular application.

As illustrated in FIGS. 6-8, the tamperproof non-contact switch device 10 of FIG. 1 is shown in various modes of operation wherein each mode may be determined by the arrangement of the access keys 12, 14. In particular, FIG. 6A illustrates a default mode wherein both access keys 12, 14 may be set in place. As provided in the corresponding circuit of FIG. 6B, the presence of both magnetic access keys 12, 14 may cause the normally-closed access switches 124, 126 to remain in an opened state, or not conducting current. Accordingly, both nodes A, B are left disconnected and unable to transmit a signal to a connected control unit. In response to disconnected nodes A, B, a control unit programmed to monitor nodes A, B may continue to deny all access to control unit parameters.

In FIG. 7A, the first access key 12 remains installed while the second access key 14 is removed from the second aperture 18. As illustrated in the corresponding circuit of FIG. 7B, this arrangement may cause the second access switch 126 to close, or conduct current, while the first access switch 124 remains in a non-conducting opened state. Node A is left disconnected and unable to transmit a signal to a control unit. However, node B is now connected and conducting current from a common reference voltage, and thus, may transmit a corresponding signal to a control unit. Such a combination of signals at nodes A, B may instruct a predetermined program or software stored within the control unit to grant a user access to some but not all parameters.

Furthermore, FIG. 8A illustrates the device 10 with both access keys 12, 14 removed. The arrangement shown may correspond to the schematic of FIG. 8B wherein both switches 124, 126 are closed and connected to a common DC reference. A connected control unit programmed to monitor access switches 124, 126 may now detect a current from both nodes A, B, and thus, grant user access to all control parameters accordingly. The control unit may also be configured to deny or grant access according to alternative access key 12, 14 arrangements and/or switch 124, 126 outputs. The non-contact switch 10 may also include fewer or more than two access switches 124, 126 to accommodate for fewer or more modes of operation, respectively.

Figure 9B:
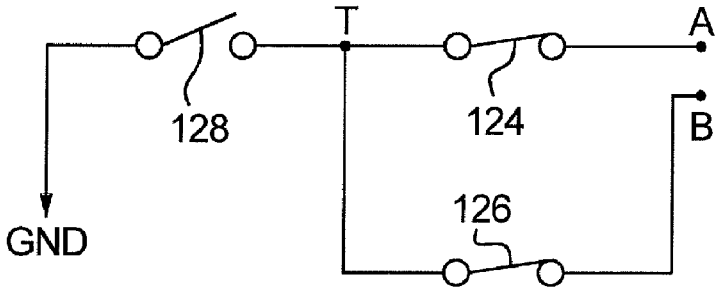

In order to demonstrate the tamper-detection capabilities of the non-contact device, 10, FIG. 9A illustrates the device 10 in the presence of an external defeat magnet 40. Initially, the device 10 is assumed to be in a default mode, as illustrated in FIG. 6A, wherein all access to a control unit is denied. More specifically, before the defeat magnet 40 is introduced to the device 10, the magnetic field created by the access keys 12, 14 maintains an open circuit across both access switches 124, 126 while the tamper detection 128 switch remains closed. As shown in FIG. 9B, when a defeat magnet 40 is introduced to the device 10, the magnetic field created by the defeat magnet 40 may counter the magnetic fields created by the access keys 12, 14, and as a result, close the access switches 124, 126. Simultaneously, the magnetic field created by the defeat magnet 40 also causes the tamper detection switch 128 to open. As the tamper detection switch 128, which is now open, is arranged in series to both access switches 124, 126, there is no connection between nodes A, B and the common DC reference. A connected control unit therefore ignores the state of the access switches 124, 126 as long as the tamper detection switch 128 is open, or as long as tamper is detected. Moreover, as far as the control unit is concerned, access keys 12, 14 are still installed. Accordingly, access is denied and the integrity of the device 10 is maintained. In the absence of such a tamper detection switch 128, nodes A, B would connect to the common DC reference and falsely instruct the control unit to grant access to all parameters.

While only certain embodiments have been set forth, alternatives and modifications will be apparent from the above description to those skilled in the art. These and other alternatives are considered equivalents and within the spirit and scope of this disclosure and the appended claims.

What is claimed:

1. A tamperproof non-contact switch device for restricting access to a control unit, comprising:

an access panel having an exterior and an interior surface;

at least two access switches and a tamper detection switch disposed on the interior surface of the access panel, the access and tamper detection switches being magnetically actuatable and in electrical communication with the control unit;

at least two access keys removably disposed on the exterior surface of the access panel, each access key capable of magnetically actuating only one access switch;

the exterior surface of the access panel further includes a lockable cover restricting access to the access keys;

wherein the tamper detection switch is equidistant from each of the access switches, said tamper detection switch for detecting a foreign magnetic source in the vicinity of either access switch;

the access keys are magnetized bolts; and wherein each access key is in axial alignment with its corresponding access switch.

2. The tamperproof non-contact device of claim 1, wherein the access keys are never in direct contact with the access switches.

3. The tamperproof non-contact device of claim 1, wherein the access keys are provided with a lead seal.

4. The tamperproof non-contact device of claim 1, wherein the access keys are unable to actuate the tamper detection switch.

5. The tamperproof non-contact device of claim 1, wherein the access switches are shielded with ferrite rings and the tamper detection switch is unshielded.

6. A tamperproof non-contact device for restricting access to a control unit, comprising:

an access panel having an exterior and an interior surface;

a first access switch, a second access switch, and a tamper detection switch disposed on the interior surface of the access panel, the access and tamper detection switches being magnetically actuatable and in electrical communication with the control unit;

a first magnetized access key removably positioned on the exterior surface of the access panel and in axial alignment with the first access switch, the first magnetized access key capable of actuating the first access switch; and a second magnetized access key removably positioned on the exterior surface of the access panel and in axial alignment with the second access switch, the second magnetized access key capable of actuating the second access switch;

the exterior surface of the access panel further includes a lockable cover restricting access to the access keys;

the tamper detection switch is equidistant from each of the access switches, said tamper detection switch for detecting a foreign magnetic source in the vicinity of either access switch; and wherein the access keys are magnetized bolts.

7. The tamperproof non-contact device of claim 6, wherein the first and second access keys are never in direct contact with the first and second access switches.

8. The tamperproof non-contact device of claim 6, wherein the first and second access keys are provided with a lead seal.

9. The tamperproof non-contact device of claim 6, wherein the first and second access keys are unable to actuate the tamper detection switch.

10. The tamperproof non-contact device of claim 6, wherein the first and second access switches are shielded with ferrite rings and the tamper detection switch is unshielded.

11. A tamperproof non-contact device for an enclosure restricting access to a control unit, comprising:

a first access switch, a second access switch, and a tamper detection switch disposed on an interior of the enclosure, the access and tamper detection switches being magnetically actuatable and in electrical communication with the control unit;

a first access key removably disposed on an exterior of the enclosure and in axial alignment with the first access switch, the first access key capable of magnetically actuating the first access switch; and a second access key removably positioned on the exterior of the enclosure and in axial alignment with the second access switch, the second access key capable of magnetically actuating the second access switch;

the exterior surface of the enclosure further includes a lockable cover restricting access to the access keys;

the tamper detection switch is equidistant from each of the access switches, said tamper detection switch for detecting a foreign magnetic source in the vicinity of either access switch; and wherein the access keys are magnetized bolts.

12. The tamperproof non-contact device of claim 11, wherein the first and second access keys are provided with a lead seal.

13. The tamperproof non-contact device of claim 11, wherein the first and second access switches are shielded with ferrite rings and the tamper detection switch is unshielded.

* * * * *